United States Patent [19]

Kato et al.

[11] Patent Number: 4,752,251

[45] Date of Patent: Jun. 21, 1988

[54] ELECTRICAL CONNECTOR

[75] Inventors: Shinichi Kato, Atsugi; Takuya Yamazaki, Omiya, both of Japan

[73] Assignees: Nissan Motor Co., Ltd., Yokohama; Kanto Seiki Co., Ltd., Omiya, both of Japan

[21] Appl. No.: 619,455

[22] Filed: Jun. 11, 1984

[30] Foreign Application Priority Data

Jun. 16, 1983 [JP] Japan ..... 58-108362

[51] Int. Cl.[4] ..... H01R 13/502

[52] U.S. Cl. ..... 439/752; 439/701

[58] Field of Search ..... 339/196 M, 196 R, 206 R, 339/210 R, 210 M, 217 R, 217 T, 198 J, 211, 206 P, 217 PS, 217 S

[56] References Cited

U.S. PATENT DOCUMENTS

| | | | |
|---|---|---|---|
| 3,648,213 | 3/1972 | Kebder . | |
| 3,680,035 | 7/1972 | Teagno et al. . | |
| 3,686,619 | 8/1972 | McCardell et al. . | |
| 3,763,458 | 10/1973 | Tsermins et al. . | |
| 3,848,946 | 11/1974 | Halley et al. | 339/210 M |
| 3,852,703 | 12/1974 | Carney et al. . | |
| 3,982,805 | 9/1976 | Irie . | |
| 4,017,141 | 4/1977 | Bury et al. | 339/196 M |
| 4,080,038 | 3/1978 | Latta et al. | 339/76 |
| 4,127,314 | 6/1978 | Hasimoto . | |
| 4,200,350 | 4/1980 | Zimmerman | 339/210 M |
| 4,226,494 | 10/1980 | Mazzeo et al. | 339/103 R |
| 4,402,564 | 9/1983 | Frantz | 339/91 R |

FOREIGN PATENT DOCUMENTS 59-3878 1/1984 Japan .

OTHER PUBLICATIONS

Nissan Technical Journal, Dec. 1982, p. 123, FIG. 13.

*Primary Examiner*—Gil Weidenfeld
*Assistant Examiner*—Thomas M. Kline
*Attorney, Agent, or Firm*—Foley & Lardner, Schwartz, Jeffery, Schwaab, Mack, Blumenthal & Evans

[57] ABSTRACT

An electrical connector comprises a housing formed with bores opening in an end wall thereof and locking arrangement for holding an electrical terminal in each of the bores, and a cover including an end wall and a peripheral wall. The cover is formed with partitions defining grooves extending inwardly from a predetermined portion of the peripheral wall thereof. The cover is formed also with projections at ends of some of the partitions. Cutouts are formed in the remaining portion of the peripheral wall of the cover. The housing has slots for receiving the projections of the cover and projections for engaging in the cutouts of the cover.

6 Claims, 2 Drawing Sheets

ELECTRICAL CONNECTOR

BACKGROUND OF THE INVENTION

The present invention relates to an electrical connector, and more particularly to an electrical connector wherein a housing has formed therethrough a plurality of bores, each provided with locking means for securely holding an electrical terminal therein, and a cover is mounted to the housing so as to engage a tail end portion of each of the electrical terminals in order to prevent the removal of the electrical terminals from the housing.

A known electrical connector falling into the above category comprises a housing and a cover which serves as a retainer. The housing has a peripheral wall including four side wall sections. In order to allow electric lead wires connected to electrical terminals to extend, the cover is formed with partitions defining therebetween grooves which extend inwardly from a portion of a peripheral wall thereof. The housing has projections on three side wall sections, while the cover is formed with cutouts which are adapted to receive therein the projections of the housing, respectively, when the cover is pressed toward the housing. This known electrical connector is illustrated in FIG. 13 on page 124 of Nissan Technical Journal, Dec., 1982. When the cover is mounted on the housing, the partitions engage with tail end portions of the terminals, preventing the removal of the terminals from the housing. However, the cover is likely to be removed from the housing if the lead wires are pulled away from the housing with a strong force, because the cover is engaged with the housing at three side wall sections of the housing only.

SUMMARY OF THE INVENTION

According to the present invention, there is provided an electrical connector wherein a cover is firmly mounted to a housing so that the cover is less likely to be removed from the housing even when electric lead wires connected to electrical terminals are pulled away from the housing with a strong force, but it is easy to mount the cover to the housing.

Specifically, according to the present invention, an electrical connector comprises a housing formed with a bore means opening in an end wall thereof and locking means for holding an electrical terminal in the bore means, and a cover formed with partition means defining groove means extending inwardly from a predetermined portion of the peripheral wall thereof. The cover is formed with projecting means on the predetermined portion of the peripheral wall. The cover is formed also with engaging means on the remaining portion of the peripheral wall thereof. The housing has slot means for receiving the projecting means and engaging means for engaging with the engaging means of the cover.

DETAILED DESCRIPTION OF THE INVENTION

Figure 1:
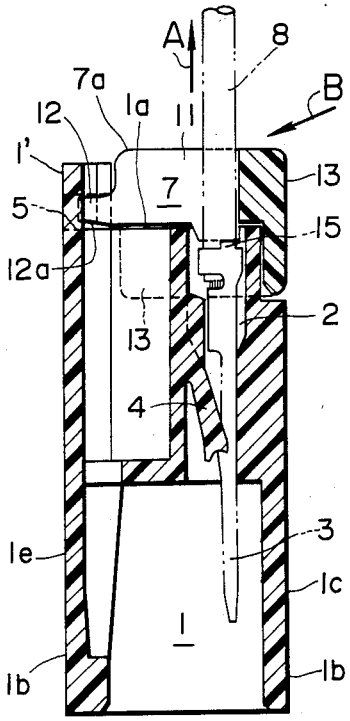
FIG. 1 is a schematic sectional view of a housing of an electrical connector taken through I—I of FIG. 3 with a cover mounted thereto.

Referring to FIGS. 1 to 8, an embodiment of an electrical connector according to the present invention is described.

Referring to FIGS. 1, 2, 3 and 4, the electric connector comprises a housing 1 of a resin material. The housing 1 includes an end wall 1*a* and a peripheral wall 1*b* connected to the end wall 1*a* and extending in a predetermined direction. The peripheral wall 1*b* has four side wall sections 1*c*, 1*d*, 1*e* and 1*f* as best seen FIG. 3. The housing 1 is formed with bore means 2 having one end opening in the end wall 1*a* and extending inwardly from the end wall 1*a*. The bore means includes eight elongate bores 2 in this embodiment. The housing 1 is formed also with locking means 4 for holding an electrical terminal 3 shown in phantom in FIG. 1 in the bore means 2. The locking means 4 extends into each of the bores 2, although for the sake of simplicity only one of the bores 2 is illustrated to have the locking means 4 in FIGS. 3 and 4. The locking means 4 biases the electrical terminal 3 against the bore wall so as to securely hold same in the bore 2. The electrical terminal 3 has a tail end portion 15 connected to an electric lead wire 8 shown in phantom in FIG. 1. The housing 1 has a wall portion 1' extending from the side wall section 1*e* beyond the level of the end wall 1*a*. This wall portion 1' has formed therein four slots 5. Three projections 6 are formed on the peripheral wall 1*b* of the housing 1 and are disposed on three side wall sections 1*c*, 1*d* and 1*f* respectively.

The electrical connector also comprises a cover 7 of a resin material serving as a retainer.

Figure 5:
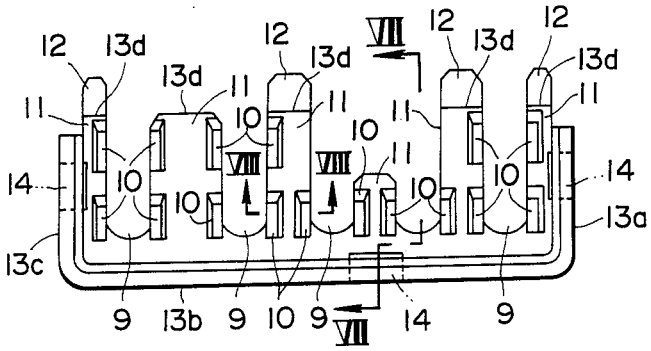
FIG. 5 is a bottom view of the cover.
Figure 7:
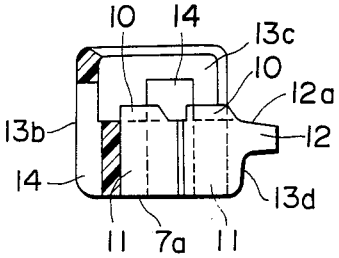
FIG. 7 is a section of the cover taken through VII—VII of FIG. 5.
Figure 6:
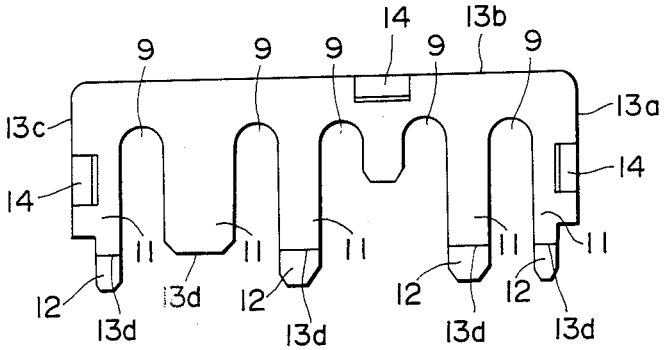
FIG. 6 is a plan view of the cover.

Referring to FIGS. 1, 5, 6, 7 and 8, the cover 7 includes an end wall 7*a* and a peripheral wall 13. The peripheral wall 13 includes three side wall sections 13*a*, 13*b* and 13*c* as best seen in FIG. 5. The cover 7 also includes partition means 11 defining five grooves 9 extending inwardly from a fourth side wall section 13*e*. The grooves 9 allow insertion of electric lead wires connected to the electrical terminals into the cover 7. The partition means includes a plurality of partitions 11. Four of the partitions 11 have projections 12 adapted to be inserted into the slots 5 formed in the wall section 1' of the housing 1. The cover 7 has three cutouts 14 formed in the side wall sections 13*a*, 13*b* and 13*c* extending inwardly from the end wall 7*a*. The cutouts 14 are adapted to engage with projections 6 formed on the side wall sections 1*c*, 1*d* and 1*f* of the housing 1. The partitions 11 are formed with projections 10 adapted to extend inwardly in the corresponding bores 2 so as to engage the tail end portions 15 of the electrical terminal for preventing removal of the electrical terminals 3 out of the bores 2, as best seen in FIG. 1. As best seen in FIG. 1, each of the projections 12 has a side 12*a* tapered upward as viewed in FIG. 1 so as to allow the cover 7 to be inserted into the slots 5 in a direction indicated by an arrow B.

Referring to FIG. 1, assembly of the electrical connector will be described.

Figure 2:
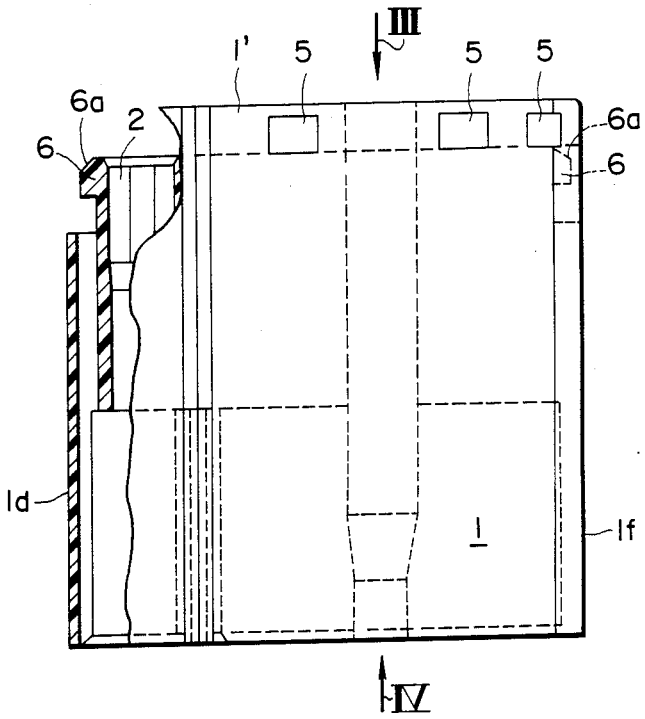
FIG. 2 is a front elevation, partly broken away, of the housing as viewed along an arrow II in FIG. 3 or as viewed along an arrow II' in FIG. 4.
Figure 3:
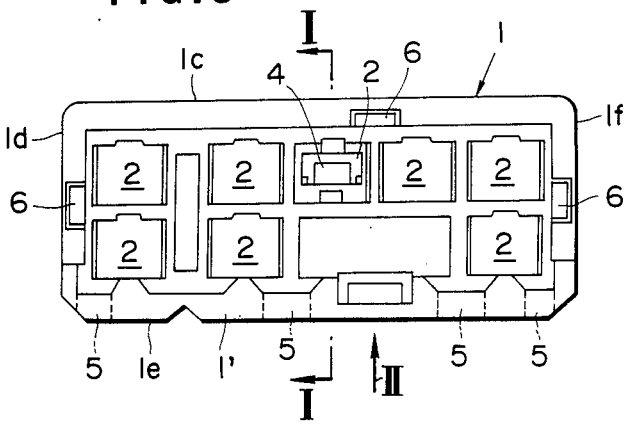
FIG. 3 is a plan view of the housing as viewed along an arrow III in FIG. 2.
Figure 4:
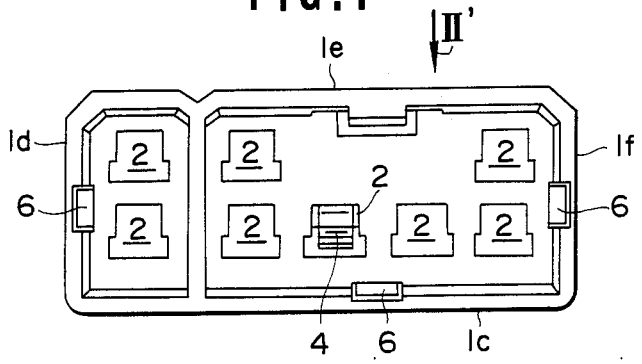
FIG. 4 is a bottom plan view of the housing as viewed along an arrow IV in FIG. 2.

The electrical terminals 3, each connected to electric lead wires 8, are inserted deeply into the bores 2 of the housing 1 until they are locked by the locking means 4. With the electric lead wires 8 inserted into the grooves 9, the cover 7 is inserted into slots 5 in the direction indicated by the arrow B in FIG. 1 and placed onto the end wall 1*a* of the housing 1. Then, the cover 7 is pressed toward the end wall 1*a* of the housing 1 until the projections 6 on the housing 1 fit in the cutouts 14 formed in the cover 7. In the process, the side wall sections 13*a*, 13*b* and 13*c* formed with cutouts 14 are slightly warped outwards as they engage the projections 6. To facilitate the warping of these side wall sections, each of the projections has a tapered side 6*a* as best seen in FIG. 2.

Figure 8:
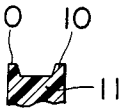
FIG. 8 is a fragmentary section taken through VIII—VIII of FIG. 5.

In the illustrated position in FIG. 8, a pair of projections 10 of the partitions 11 extending into each of the bores 2 engage with the tail end portion 15 of the electric terminal 3. This prevents removal electrical terminal 3 from the housing 1 when the electric lead wire 8 is pulled in the direction indicated by an arrow A in FIG. 1, thus allowing the locking means 4 to securely hold the electrical terminal in the proper position in the bore 2.

From the description as above, it will be appreciated that the cover 7 is firmly mounted to the housing 1 at four side wall sections of the peripheral wall 1*b* of the housing 1. Thus, the cover 7 is less likely to be removed from the housing 1 even when the electric lead wires are pulled away from the housing with a strong force. Furthermore one side wall section 13*d* of the cover 7 is engaged with the side wall section 1*e* of the housing 1 by inserting the projections 12 into the slots 5, thus facilitating mounting of the cover 7 onto the housing 1.

Because the cover 7 is a separate piece from the housing 1, the grooves 9 extend inwardly in parallel from one side wall section of the cover 7, and the projections 12 are to be inserted into the slots 5, it is now possible to place the cover 7 onto the end wall 1*a* of the housing 1 in the direction indicated by the arrow B in FIG. 1. This further facilitates assembly.

With the cover 7 firmly mounted to the housing 1 as described above, the electrical terminals 3, each being engaged by the projections 10 of the cover 7, are securely held in the housing 1.

According to the described embodiment of the electric connector, the cover 7 is a separate piece from the housing 1. Thus, the cover 7 can be easily mounted or removed from the housing 1, facilitating assembly or disassembly.

Furthermore, the fact that the cover 7 and housing 1 are separate pieces permits the use of compact metal molds in forming the cover 7 and the housing 1 because it is not necessary to prepare a large single metal mold for forming a unitary housing and cover structure. With the same metal mold, covers for housings of male and female connectors can be formed if the housing has a plan view whose profile is synmetrical about a plane extending in parallel and spaced equidistant from the parallel side wall sections. As a result, the effeciency in assembly procedures has been greatly increased.

What is claimed is:

1. An electrical connector for use with a plurality of electrical terminals, each having a tail end portion connected to an electric lead wire, comprising:

a housing comprising:

wall means defining a first end wall and a first peripheral wall connected to said first end wall, slots disposed in said first peripheral wall, a plurality of bores, each having one end opening within said first end wall wherein each of said plurality of bores is adapted to receive an electrical terminal, having associated lead wires, and a cover comprising:

a second end wall and a second peripheral wall extending from said second end wall;

partition means for defining a plurality of cutouts adapted to receive the electric lead wires, said partition means comprising a plurality of partitions having first projections disposed thereon, wherein said first projections are received in said slots of said housing;

wherein said first projections of said plurality of partitions of said cover which are received in said slots of said housing cause said cover to assume a predetermined position, and said plurality of partitions are engaged with the electrical terminals to prevent removal of the electrical terminals from said plurality of bores of said housing.

2. An electrical connector as claimed in claim 1, wherein said first peripheral wall of said housing has a wall portion extending beyond said first end wall of said housing, said wall portion being comprised with said slots.

3. An electrical connector as claimed in claim 2, wherein said plurality of partitions are formed with second inwardly extending projections so constructed and arranged as to prevent removal of the electrical terminals, wherein each of said second projections is inserted into one of said plurality of bores of said housing.

4. An electrical connector as claimed in claim 3, further comprising a plurality of third projections formed on said first peripheral wall of said housing, and aperture means extending inwardly into said second peripheral wall of said cover for receiving said plurality of third projections of said housing.

5. An electrical connector as claimed in claim 1, wherein said housing includes locking means extending into said plurality of bores for holding the electrical terminals received in said plurality of bores.

6. An electrical connector as claimed in claim 1, wherein said second peripheral wall of said cover includes a first side wall section, a second side wall section, and a third side wall section, said second and third side wall sections extending from said first side wall section parallel to each other, said connector further comprising a plurality of second projections formed on said first peripheral wall of said housing and aperture means formed in said first, second, and third side wall sections of said second peripheral wall, respectively, for receiving said plurality of second projections of said housing.

* * * * *